United States Patent [19]

Isaka

[11] Patent Number: 4,458,573

[45] Date of Patent: Jul. 10, 1984

[54] SPEED GOVERNOR FOR MUSIC BOX

[75] Inventor: Akihiko Isaka, Okaya, Japan

[73] Assignee: Kabushiki Kaisha Sankyo Seiki Seisakusho, Nagano, Japan

[21] Appl. No.: 412,064

[22] Filed: Aug. 27, 1982

[30] Foreign Application Priority Data

Aug. 28, 1981 [JP] Japan ..... 56-127438
Apr. 19, 1982 [JP] Japan ..... 57-64916

[51] Int. Cl.[3] ..... G10F 1/06
[52] U.S. Cl. ..... 84/95 R
[58] Field of Search ..... 84/94 R, 95 R, 96, 97, 84/98, 99, 100, 101; 74/114, 336 R

[56] References Cited

U.S. PATENT DOCUMENTS 2,504,918 4/1950 Bergen ..... 84/95
2,836,260 5/1958 Nozawa ..... 84/95
3,390,599 7/1968 Komatsu ..... 84/96

FOREIGN PATENT DOCUMENTS 201025 1/1939 Switzerland ..... 84/94

*Primary Examiner*—L. T. Hix
*Assistant Examiner*—Brian W. Brown
*Attorney, Agent, or Firm*—Sughrue, Mion, Zinn, Macpeak and Seas

[57] ABSTRACT

A speed regulator for a gear train is provided in the form of a flexible rotor which provides substantial air resistance braking when rotated, and which, when rotated at high speeds, elastically deforms to engage a brake member arranged proximate the rotor, such that both air friction and surface contact friction operate to maintain the gear train output speed constant.

7 Claims, 14 Drawing Figures

SPEED GOVERNOR FOR MUSIC BOX

BACKGROUND OF THE INVENTION

The present invention relates to a speed governor for a music box.

In a music box driven by a main spring, for example, a speed governor or regulator is provided to control play at a constant speed.

An air governor system used for controlling the play speed by using the air resistance of a fan running at a high speed, and a centrifugal governor system which controls the speed by using weights which move radially due to centrifugal force and a brake part with which an outer periphery of the weight contact have been generally known hitherto.

Both of the above systems are effective to rotate a worm shaft with a worm gear driven by the gear train to be regulated, and the fan or the weights are mounted on the worm shaft.

Although the above air governor system is simple in construction, it is disadvantageous in that the force controlling the speed is small. Namely, it is difficult to always keep the gear train at a constant speed in such a governor system since the air resistance of the fan is utilized merely upon a change in the driving forces applied to the gear train to be regulated. When a spring serves as a driving source the driving force is varied from the initial stage when the wound-up spring begins to be released, to subsequent stages. In order to obtain a large controlling force in this system, it is necessary that the air resistance be increased by enlarging the size, particularly, the diameter of the fan or otherwise by increasing the speed acceleration ratio with respect to the driving source. However, a spacing problem would be caused by enlarging the fan. Also, the number of teeth of the gear constituting the wheel train will have to be adjusted to increase the speed acceleration ratio. Another problem in mechanical strength will arise in minimizing a pitch of the gear, and hence the pitch cannot be so minimized below a certain limit.

The centrifugal governor system is advantageous in that it provides a large force for controlling the speed, i.e. brake power, as compared with the air governor system; however, the brake part must be provided around the weight part, which is not preferable. Further, another disadvantage arises such that a stop member for the music box will be limited as to location.

With reference to the stop member for the music box, a problem is also unavoidable in the air governor system. The fan consists of a thin metal strip or blade which functions to stop the operation of the music box, in other words, to stop the gear train in cooperation with the stop member. In this case, however, an overload which may damage the worm shaft and its bearing could be imposed thereon. Therefore, these members must be provided with suitable strength and construction. The fan is mounted on the worm shaft through a press fit, which may damage the worm, and hence the worm shaft must be subjected to quench hardening beforehand.

SUMMARY OF THE INVENTION

This invention has been made in view of the various difficulties described above, and an object of the invention is to provide a speed governor or regulator of simple constitution and of stable speed governing or regulating performance, which employs a simple construction which has the advantages of the air governor system and reliable brake power.

This and other objects of the invention can be attained by providing a speed governor comprising a worm gear driven by the gear train to be regulated, a worm shaft rotated by the worm gear, a rotor provided on the worm shaft through connections subject to elastic deformation, a brake part disposed adjacent to the top, bottom or end of the rotor and capable of sliding on the rotor, which is characterized in that the rotor connection deviates in the axial direction of the worm shaft from the plane including the center of gravity of the rotor and is perpendicular to the worm shaft.

According to the invention, a governing action using the air resistance of the rotor is normally obtained when the worm shaft runs at a low speed, and additionally, at high speeds a reliable brake power is generated by the contact resistance between the rotor and the brake part, the rotor being displaced axially and radially of the worm shaft at high speed running.

According further to the invention, speed governing is normally secured even from minimizing the speed acceleration ratio of the worm shaft to the gear train to be regulated, therefore the pitch of the gear can be taken large. This may facilitate manufacture of the gear and reduce the cost accordingly.

Furthermore, the rotor can easily be mounted on the worm shaft through a press fit if it is formed of an elastic material such as rubber. Thus, when the rotor is engaged with a stop, the break-down of the worm shaft and associated bearings can be prevented, as the elasticity of the rotor may absorb shocks applied thereto.

According to the present invention there is provided a speed regulating device for a music box including a drive source, drum means having a plurality of pins, metal diaphragm means hving a plurality of associated reeds and engaged by said pins for producing sounds, and gear train means regulated by the speed regulating device, the gear train means being coupled to the drum means to drivingly rotate the same, the speed regulating device including a worm gear driven by said gear train means; a worm shaft fixed to the worm gear; a rotor unit including weights and parts which are elastically deformable; and brake means capable of contacting the weights, wherein at least one end of the elastically deformable parts is positioned to deviate, in an axial direction of sais worm shaft, from a plane which includes the centers of gravity of said weight parts.

DETAILED DESCRIPTION OF THE PREFERRED EMBODIMENTS

The present invention will now be described in detail with reference to the preferred embodiments illustrated herein.

Figure 1:
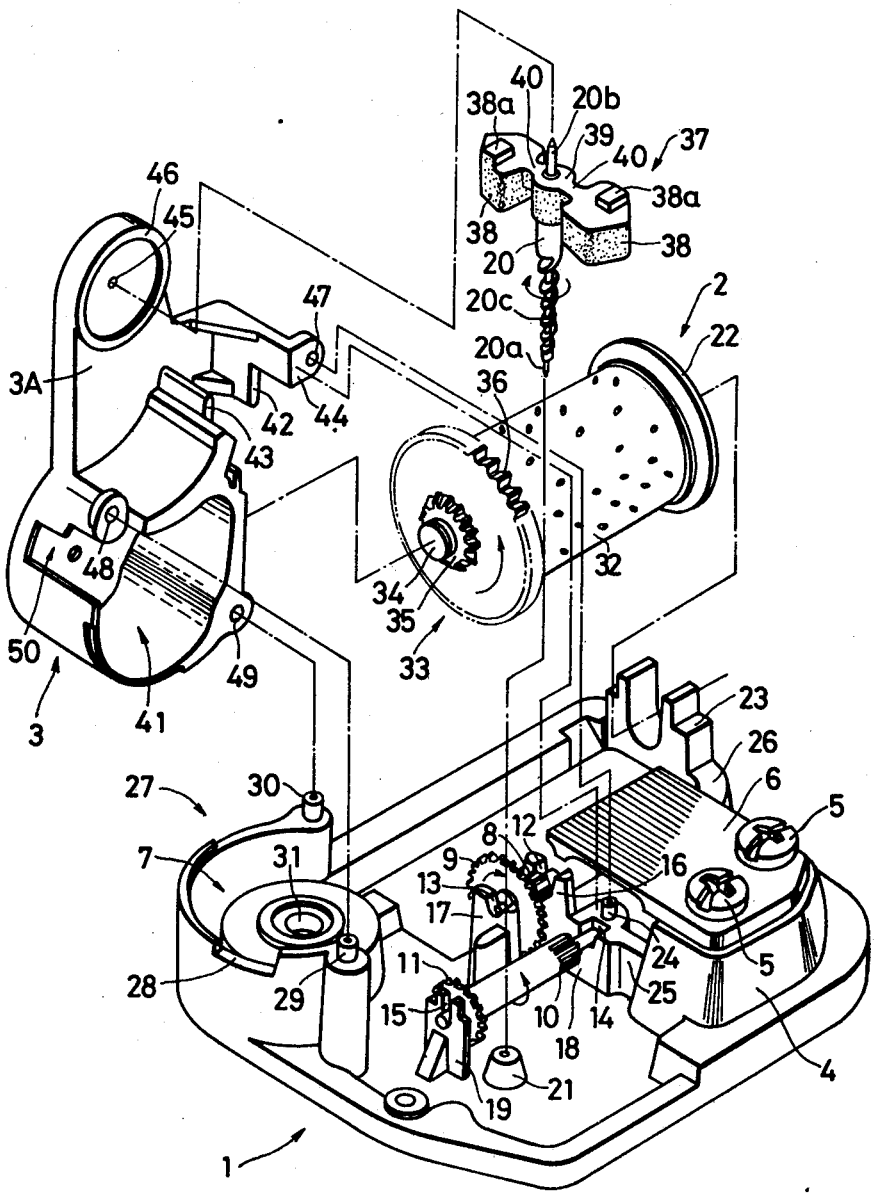
FIG. 1 is an exploded perspective view of the movement of a music box incorporating a speed regulating device according to the present invention.

FIG. 1 is an exploded perspective view of a movement, wherein reference numeral 1 denotes a frame, 2 denotes a drum and 3 denotes a spring enclosure. A solid diaphragm member 6 is fixed, in the case of this embodiment, to a seat 4 of the frame 1 with set screws 5. The diaphragm member is formed of a multitude of vibrating reeds of different frequency which are incorporated in parallel therein.

There are formed, on the frame 1, a concavity 7 constituting a bottom of the spring enclosure 3, and piers 16, 17, 18 and 19 on which bearing grooves 12, 13, 14 and 15 are formed. Bearing gears 8, 9, 10 and 11 constitute a gear train for transmitting the driving force of the spring (not illustrated) to a speed governing or regulating mechanism described later. A bearing part 21 supports a lower end 20*a* of a worm shaft 20 of a speed governing mechanism, and a bearing part 23 rotatably supports a solid or hollow shaft (not shown) formed on one end plate 22 of the drum 2. A connection boss 24 is formed on the pier 18. The seat 4 is connected to the pier 18 and the bearing part 23 through ribs 25 and 26, respectively. A notch 28 at which one end of the spring (not shown) is retained and connection bosses 29 and 30 are formed on a partial circumferential wall 27 forming the concavity 7 therein. A hole 31 formed at the center of the concavity 7 is formed so that a spring winding shaft (not illustrated) is inserted into the hole 31.

The drum 2 consists of a cylinder 32 having needles for playing the vibrating reeds and end plates 22 and 33 fitted to the cylinder 32 at both ends. A shaft 34 forming one end of a rotary center shaft of the drum, a bevel gear 35 mating with a ratchet mechanism (not shown) in the spring enclosure, and a gear 36 mating with the gear 8 of the gear train are formed of synthetic resin integrally with the gear plate 35.

The gears 8 and 9 are integral with each other, and the gear 9 meshes with the gear 10. The gear 10 and the gear 11 (worm wheel) are integral with each other, and the gear 11 meshes with the worm shaft 20.

The worm shaft 20 constitutes a part of the speed governing mechanism, and a rotor 37 made of rubber of other suitable material is fitted to the shaft. The rotor 37 comprises weight parts 38 and connections 40 capable of elastic deformation which connect a boss part 39 and the weights. Projections 38*a* for making the center of gravity of the weights eccentric and also for shifting the contact position with a brake part 46, described later, on the trailing side when the rotor operates are formed on the top of the weight parts 38. An upper end 20*b* of the worm shaft 20 is formed with a point.

The spring enclosure 3 comprises a spring enclosing part 41 for enclosing the spring and the ratchet mechanism therein, shaft retainers 42, 43, 44 for preventing the shaft from being pulled apart, while coming into contact with the piers 16, 17, 18. The spring enclosure 3 incorporates a bearing hole 45 through which the upper end 20*b* of the worm shaft 20 is engaged, an annular brake part 46 around the hole 45 and along the rotary path of the projection 38*a*, fitting holes 47, 48, 49 in which the bosses 24, 29, 30 are fitted, and a notch 50 formed on the circumferenctial wall of the enclosing part 41 and engaging one end of the spring in cooperation with the notch 28. A bearing part (not shown) for supporting the shaft 34 of the drum 2 is formed partially outside of the circumferential wall of the spring enclosing part 41.

When the spring in the enclosure is wound up to rotate the gear 35, the drum 2 is rotated in the direction indicated by the arrow. The rotation of the gear 35 causes the gear 36 integral therewith to rotate, and thus the gear train associated with the gear 36 is rotated in the direction indicated by the arrow. The worm shaft 20 rotates in the direction indicated by the arrow in FIG. 3 as the gear train rotates.

At low-speed rotation, the worm shaft 20 operates with the upwardly directed force of the worm gear 20*c*, and therefore the upper end tenon 20*b* comes into contact with a spot on the ceiling of the bearing hole 45 to permit rotation even at a minute torque. The worm shaft 20 rotates with the air resistance of the weight parts 38, thus keeping the gear train running at a constant speed.

Figure 2:
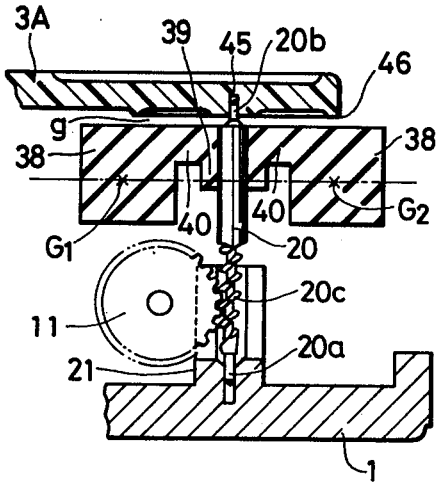
FIG. 2 is a cross-sectional view of the speed regulating device shown in FIG. 1.
Figure 3:
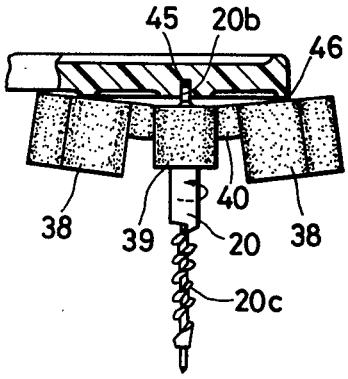
FIG. 3 is an illustration of the operating condition of the rotor shown in FIG. 2.

When the gear train runs quickly, the worm shaft 20 is accordingly rotated at a high speed. In this case, sufficient centrifugal force is applied to the weight parts 38, so that the weights are urged to separate from the boss 39, as shown in FIG. 3. However, the weight parts 38 are coupled to the worm shaft at positions deviating axially from a line including the centers of gravity $G_1$ and $G_2$(FIG. 2), and therefore, the weight parts 38 move axially upwardly. Thus, the tops of the weight parts 38 come into contact with the brake part 45, the weight parts 38 sliding on the brake part 46.

Therefore, when the worm shaft 20 runs at a high speed, two forces, i.e., the air resistance of the weight parts 38 and the contact friction resistance between the weight parts 38 and the brake part 46 are applied to the worm shaft 20, and the contact friction resistance is proportional to the centrifugal force of the weight parts 38, thereby regulating the rotational speed or rotation of the drum 3 to a constant. Further in this embodiment, a projection 38*a* is provided on the top of each weight part 38, thereby allowing the weight to come into contact with the brake part 46 at the projection 38*a* during rotation. Namely, the level of the weight parts 38 is kept low on the leading edge side of the direction of rotation and high on the trailing edge side, thereby preventing an "adhesion" phenomenon and decreasing noise at the time of contact.

When the rotation is decelerated and thus the centrifugal force of the weight parts is decreased, the rotor does not come into contact with the brake part, and only the air resistance of the rotor works as a brake.

Meanwhile, the spring in the enclosure varies in characteristics from box to box. Therefore, deviations are unavoidable in the force rotating and driving the drum, or the gear train. In other words, when a gap g (FIG. 2) is kept constant, there may arise a deviation in the timing whereat the weight parts 38 come into contact with the brake part 46 of an individual movement. Now, therefore, the rotational speed of the drum, i.e., the music playing speed, can be kept constant by variably setting the gap g. In this respect, since the weight parts 38, the connections 40 and the boss 39 are formed of elastic material, the relative position between the worm shaft 20 and the elastic rotor can easily be changed, and hence the gap g can be set very easily. The rotor can be fitted on the worm shaft easily, too. This may make it unnecessary to quench harden the worm shaft. This quench hardening process is an important and necessary process in the prior art.

Thus, the rotor is available for controlling or regulating the drum speed according to the use of air resistance together with a contact frictional force, which allows a powerful braking force to operate on the worm shaft even with a small mass of the rotor, and also minimizes the gear acceleration ratio. The pitch of the gear train can thus be enlarged, and even a gear to which a relatively large torque is applied can be molded, thereby minimizing the number of necessary mechanical parts and decreasing the cost considerably.

Furthermore, the invention is also characterized by a supporting means for the gear train and the worm shaft. That is, a simple drop-in assembly of the gears and worms into bearings may be used to ensure positional precision of those parts. Therefore, the products are easily quality controlled without deivation. This facilitates part assembly and also decreases the number of necessary parts.

In the embodiment described above, the gears and the worm shaft are dropped into the frame 1 and are supported by a supporting means 3A; however, the device is not necesarily limited thereto.

Figure 4:
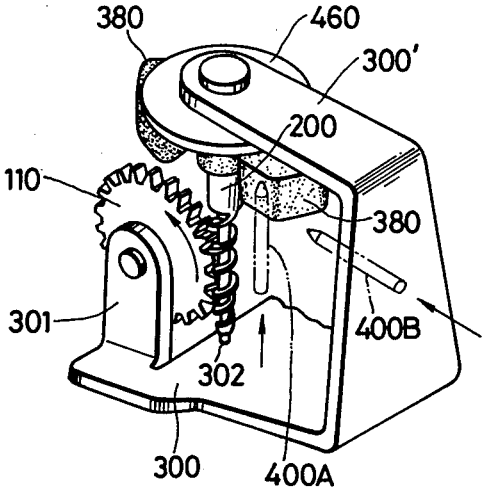
FIG. 4 is an illustration of another embodiment of a rotor unit having stop means, according to the present invention.

In FIG. 4, reference numeral 110 denotes a worm gear rotated and driven by the gear train. The worm gear 110 has one end supported on a bearing 301 and the other end supported on another bearing (not shown). The bearing 301 is formed by cutting and bending upwardly a part of a bottom board member 300. Another part 300' of the bottom board member 300 is bent upwardly and further bent in parallel to the bottom board body so as to form a worm support. A friction member 460 serving as the brake part is provided integrally with the support through a press fit. A bearing hole for a tenon of the worm shaft 200 is formed on the friction member 460. On the other hand, a bearing hole 302 for another tenon of the worm shaft 200 is formed on the bottom board member 300, and the worm shaft 200 is rotatably supported by the holes.

In FIG. 4, the worm shaft 200 comprises a shaft for fixing the weight parts 380, tenons having tips sharpened like a needle so as to rotate the shaft under light load, and a worm tooth mating with the worm gear 110. A rotor including the weight parts 380 is formed of a flexible elastic material of rubber or the like for generating centrifugal force radially outwardly at high-speed rotation, and for generating air resistance. A boss is mounted on the worm shaft through a press fit. A connection couples the boss and the weight parts. A sliding part is formed on the top of each weight part for generating a frictional force in contact with the friction member at high rotary speeds. The arrangement is such that the worm gear 110 rotates so that the worm shaft 200 will be raised upwardly as shown in FIG. 4. The friction member 460 is disposed above the worm shaft 200.

When the worm gear 110 rotates in the direction indicated by arrow in FIG. 4, the worm shaft 200 mating therewith at the worm teeth is raised upwardly, and thus the upper end tenon comes into contact with a point of the ceiling of the bearing hole upon rotation at a minute torque.

When the gear train including the worm gear 110 is rotated exceeding a given speed, the weight part 380 of the rotor is displaced in a direction apart from the boss by the centrifugal force. Since the weight part 380 is coupled to the boss at its upper end through a connection as mentioned above, it is displaced upwardly by the centrifugal force. In other words, when the centrifugal force is applied, the sliding part moves upwardly to come into contact with the friction member.

The upward displacement of the sliding part is almost proportional to the rotational speed of the worm shaft 200. Therefore, as the rotational speed of the shaft 200 increases, the frictional force between the sliding part and the friction member 460 is increased and vice versa. Namely, change in the rotation of the worm shaft 200 is converted into a change in the displacement of the rotor.

In order to stop the music box, in general, a stop member is actuated on the worm shaft to which a small rotational torque is applied and which is easy to stop. There are provided two types of stop members. In one type, the stop member is moved in the axial direction of the worm shaft so as to engage the rotor as indicated by reference character 400A in FIG. 4, and in the other type, the stop member is moved in the radial direction of the worm shaft so as to engage the rotor as indicated by reference character 400B.

In any event, the stop member functions to engage the rotor by disposing its tip into the rotational path of the rotor. According to this invention, since the rotor is formed of a flexible or elastic material such as rubber, the shock caused by the abutment between the rotor and the stop member may be eliminated.

As also described above, the formation of the rotor as a flexible member facilitates the press fitting of the member on the worm shaft, and thus quench hardening of the worm shaft may be dispensed with.

Moreover, the brake timing can be optimized according to the spring torque characteristic by changing the position of the rotor with respect to the worm shaft, in other words, the relative position of the sliding part to the friction member.

Figure 5:
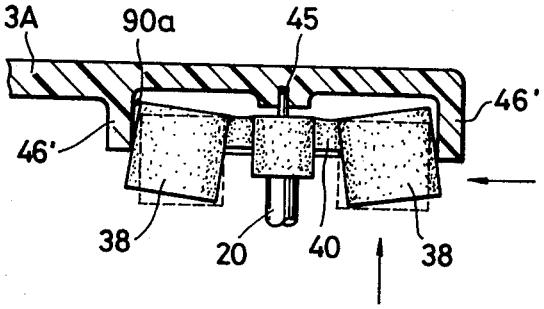
FIG. 5 is an illustration of another modification to the rotor and brake means according to the present invention.

The above described object can be likewise attained by forming the brake part 46 on the circumferential wall surface in the rotary path of the weight part 38 as indicated by 46' in FIG. 5. The broken line in FIG. 5 represents the standstill state, and the solid line represents the running state.

It is preferable that the top of the weight part of the rotor and the brake part be essentially parallel with each other to allow speed regulation, and that the center O of the top surface of the weight part to which a rotational torque is applied be brought into contact with the brake part. If these conditions are met any projection on the top surface of the weight part may be dispensed with. Actually, however, there arises an inclination $\alpha$ between the top of the weight part 38 and the brake part 46, for example, as shown in FIGS. 6 and 7, due to production errors or mechanical allowance.

Figure 6:
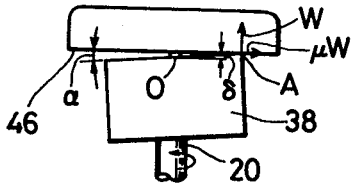
FIGS. 6 and 7 are illustrations showing the inclination of the rotor.
Figure 7:
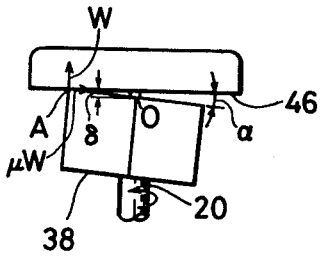

In FIG. 6 and FIG. 7, if W is the upward force according to the centrifugal rotational force of the weight part 38, $\delta$ is the distance between the center O of the weight part 38 and the brake part 46, and $\mu$ is the coefficient of friction between the weight part top and the brake part; a rightward return torque, $To=\mu W\delta$, in FIG. 7, will be applied to the weight part 38 around the center O in the case of a sliding point A on the leading edge side with respect to the center O (as shown in FIG. 7). Then, a so-called "adhesion" phenomenon is produced by the return torque through the elastic deformation generated when the weight part 38 is brought into contact with the brake part 46. Thus, a force which is excessive as compared with the torque of the worm shaft 20 is applied to the shaft, and the rotor 37 comes to a stop instantaneously. Then, the weight part 38 returns to its original shape as soon as the rotor 37 stops as above, and when its top parts from the brake part 46, the return torque to the rotor disappears, and the rotor 37 restarts rotation quickly. The weight part then again comes into contact with the brake part impulsively, generating a knocking noise.

On the other hand, where the contact point A exists on the trailing edge side with respect to the center O (as shown in FIG. 6), the return torque remains same as above; however, since its direction is opposite to that of the former, the knocking noise or "adhesion" phenomenon will not be generated.

Figure 8:
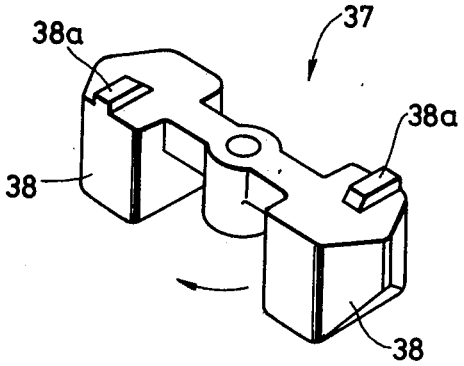
FIG. 8 is a perspective view of a rotor having projections in accordance with the invention.

In view of the above, the projection 38*a* shown in FIG. 1 and FIG. 8 is provided on the rear edge, i.e., the trailing side of the weight part 38.

With this constitution, the contact point A is kept on the trailing edge side with respect to the center O. Therefore, the "adhesion" phenomenon is prevented and noises are decreased upon braking.

Figure 9:
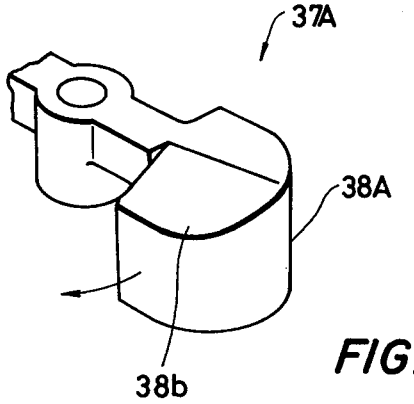
FIG. 9 is a fragmentary perpective view of another rotor having a high level portion on its top surface in accordance with the invention.

A similar effect is obtainable by providing a notch 38*b* on a weight part 38A of rotor 37A, as illustrated in FIG. 9.

It is advantageous to hold the trailing side top of the weight part higher than the leading side top so as to meet the relation between the contact point A and the center O corresponding to the above condition; however, if the point A is positioned ahead of the center O in the direction of rotation, and the forward top in the direction of rotation of the weight part is held at a low level, the adhesion phenomenon may be prevented and the noise may be effectively decreased.

Figure 10:
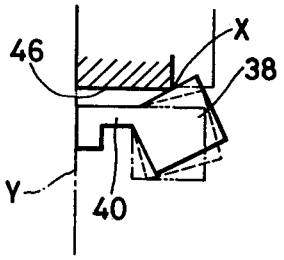
FIGS. 10 to 12 show various modifications of the weight part of the rotor and brake means in accordance with the present invention.
Figure 11:
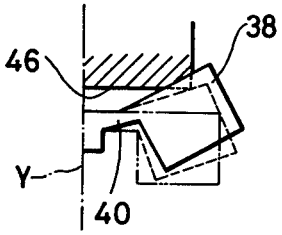
Figure 12:
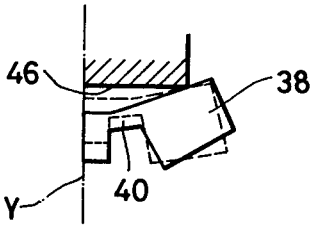

FIGS. 10 to 12 represent practical examples wherein the rotational speed is selectively set or adjusted. The weight part 38 is maintained as indicated by the solid line or the phantom line according to the rotational speed.

Various kinds of brake parts 46, which differ from each other in dimensions (the distance X from the center line Y in FIG. 10) and shape (FIG. 11) may be prepared. Therefore, for example, in order to increase the braking force to set the rotational speed at a low value, the degree of deformation is reduced such that the weight part may contact the brake part even with a small deformation. It is thus possible to set the speed as desired. FIG. 12 illustrates the case where, in order to vary the set speed, the rotor is mounted at various positions on the worm shaft. The press fit position is easily adjusted and set. Therefore, the set rotational speed can be selected or adjusted freely without increasing the number of parts.

Figure 13:
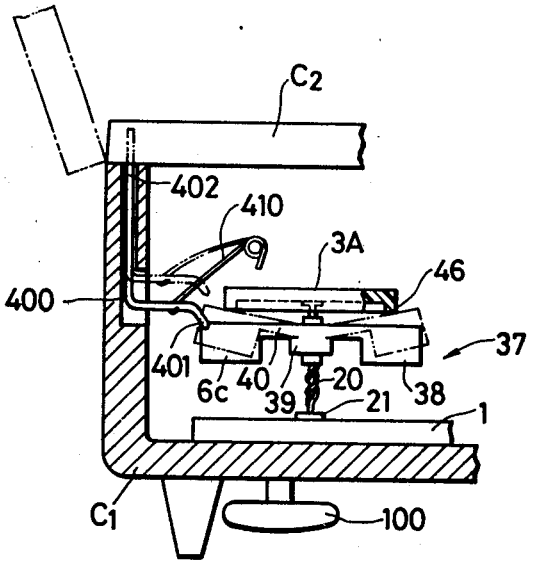
FIG. 13 is an illustration of the operation of the stop member.

In FIG. 13, reference chatacter $C_1$ denotes the casing of a toy, a jewel box, etc. in which the music box is built in, and a removable cover $C_2$ is mounted on the casing $C_1$. The movement for the music box is fixed to the casing $C_1$; however, only a part of the speed regulating mechanism is shown therein for illustration. The bearing 21 on which one end of the worm shaft 20 positioned at the terminal of the gear train is supported is formed in the frame 1. The other end of the worm shaft 20 is carried on a brake member 3A stationary with the frame. The brake member 3A has an annular brake part 46. The rotor 37 is made of elastic rubber or the like and is fixed on the worm shaft 20 through a press fit. The rotor 37 comprises the boss 39 press fitted to the worm shaft 20 and the weight parts 38 each coupled to the boss through connections 40. In the drawing, reference numeral 100 denotes a winder for the spring (not shown).

On the other hand, a stop member 400 bent in an L-shape is movably mounted in a side wall of the casing $C_1$. The stop member 400 is urged upwardly by a spring 410. One end 402 of the stop member 400 is bought into contact with one face of the cover $C_2$. The other end 401 of the stop member 400 is positioned so as to engage the rotor 37. This position will be described in detail later.

When the cover $C_2$ is opened as indicated by the chain line, the stop member 400 is urged upwardly by the spring 410. In this case, the other end 401 of the stop member 400 is positioned as indicated by the chain line so as to be disengaged from the rotor 37.

When the spring is wound and the stop member 400 is displaced to the position indicated by the chain line, the worm shaft 20 starts rotating. When the worm shaft rotates at high speed, the rotor 37 has its weight part 38 displaced axially under a centrifugal force with the connection 40 being bent. The rotor 37 so bent, as indicated by the chain line, during high-speed rotation, is subjected to a braking force with the top of the weight part 38 sliding on the annular brake part 46 of the brake member 3A, and thus the rotational speed is suppressed to within a constant range. The drum rotates at a set speed to maintain a constant playing speed.

Indicated by the solid line in FIG. 13 is the rotor 37 when not subjected to the centrifugal force. The virtual path of rotation of the rotor 37 in such a state is called the "non-flexing region." As indicated by the chain line in FIG. 13, the rotor 37 in rotation is subjected to the centrifugal force and is bent toward the brake member 3A. The path of rotation of the rotor 37 in such a state is called the "flexible region."

The end 401 of stop member 400 deviates from both the flexible and non-flexible regions. When the cover $C_2$ is shut, the stop member 400 previously held out of either path as indicated by the chain line is moved to a stop position indicated by the continuous line. Moreover, one end 401 of the member is moved in the direction indicated by arrow a in FIG. 14 to a zone Z wherein the non-flexible region and the flexible region overlap.

Figure 14:
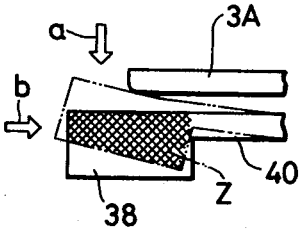
FIG. 14 is an illustration of the paths of the weight part of the rotor according to the invention.

In FIG. 14, therefore, the rotor 37 rotating at the bent position indicated by the chain line is stopped by the engagement with the stop member. There is a possibility that the end 401 may collide with the top of the weight part 38, when the stopper member 400 moves to the stop position in the direction indicated by the arrow a. In other words, the stop member and the rotor may interfere with one another with the end 401 pressing downwardly on the rotor. Such phenomenon may cause damage to the stop member and/or the rotor.

However, according to this invention, since the rotor 37 is formed of elastic material, the rotor will bend at the connection 40 to escape downwardly to avoid the above interference. Therefore, the stop member will not remain engaged with the weight part but will engage the side of the other weight part turned subsequently, thereby stopping the worm shaft. In this embodiment, since two weight parts 38 are provided, even if the stop member is brought into contact with the top of one of weight parts, the worm shaft will rotate through 180° and the otherweight part will then engage the stop member.

The "stop" direction is not limited only to that of the arrow a indicated in FIG. 14 along which the stop member is disposed into the flexible region, and various directions including that of arrow b are conceivable. In the case, for example, where the stop member comes into the flexible region from the direction indicated by the arrow b, even if the stop member abuts a side edge of a weight part 38, the weight part will escape as the connection 40 is bent, therefore no problems due to this abutment will occur. It is preferable that the stop member move in a direction other than the extending direction of the connection. The reason is that if the axis of the connection is in alignment with the moving direction of the stop member, when the stop member abuts the weight part, it is difficult to deform the connection. This is not a serious problem however because of the elasticity of the rotor.

Of course, the stop will not function perfectly unless is it movable between the zone Z and the region in which both the non-flexible and flexible regions are excluded in FIG. 14.

What is claimed is:

1. A speed regulating device for a music box including a drive source, drum means having a plurality of pins, metal diaphragm means having a plurality of associated reeds, and gear train means to be regulated by said speed regulating device, said gear train means being coupled to said drum means to drivingly rotate said drum means, said speed regulating device comprising a worm gear driven by said gear train means; a worm shaft fixed to said worm gear; a rotor unit including weight parts and elastic parts which are elastically deformable; and brake means capable of contacting said weight parts, wherein at least one end of said elastic parts is positioned to deviate in an axial direction of said worm shaft from a radial plane which includes the centers of gravity of said weight parts.

2. The device according to claim 1, wherein said rotor unit further includes a boss portion coupled to said worm shaft, said boss portion, said elastic parts and said weight parts being integrally formed of elastic material.

3. The device according to claim 2, wherein said boss portion is press fitted to said worm shaft.

4. A speed regulating device for a gear train, comprising; a worm shaft driven by said gear train, an elastically deformable rotor disposed on said worm shaft, brake means disposed proximate said rotor and being engagable with said rotor, said rotor including weight means mounted to a central portion of said rotor in a manner so as to be moved axially of said worm shaft as the rotational speed of said shaft increases, said weight means engaging said brake means at a predetermined speed of said shaft to brake said gear train.

5. The device according to claims 1 or 4, said rotor being substantially braked by air resistance whe rotating at relatively lower speeds, and being braked by both air resistance and frictional contact with said brake means at relatively higher speeds.

6. The device according to claim 4, said weight means being connected to said central portion of said rotor by an elastic connection positioned offset from a line joining centers of gravity of said individual weight means.

7. The device according to claims 1 or 4, said weight means being formed and arranged such that said engagement with said brake means occurs at a trailing portion of said weight means with respect to the rotary direction thereof.

* * * * *